US005490617A

United States Patent [19]

Jochim et al.

[11] Patent Number: 5,490,617

[45] Date of Patent: Feb. 13, 1996

[54] ABDOMINAL BINDER STRETCHER

[76] Inventors: Roland F. Jochim; Dorothy M. Jochim, both of P.O. Box 114, 302 S. Oak St., Purcell, Mo. 64857

[21] Appl. No.: 276,788

[22] Filed: Jul. 18, 1994

[51] Int. Cl.[6] ..... D06C 13/00; A47G 25/00

[52] U.S. Cl. ..... 223/61; 223/85; 223/52; 38/70; 38/102.1

[58] Field of Search ..... 223/61, 89, 94, 223/85, 52, 75, 84; 38/69, 70, 102.1, 102

[56] References Cited

U.S. PATENT DOCUMENTS

| | | | |
|---|---|---|---|
| 1,184,743 | 5/1916 | Griffiths | 223/94 |
| 1,559,634 | 11/1925 | Lake | 38/70 |
| 2,055,744 | 9/1936 | Grunkemeyer | 38/70 |
| 2,437,457 | 3/1948 | Clements | 38/70 |

FOREIGN PATENT DOCUMENTS

| | | | |
|---|---|---|---|
| 619538 | 7/1926 | France | 38/70 |
| 33510 | 4/1885 | Germany | 38/70 |
| 11030 | 3/1905 | United Kingdom | 38/70 |
| 3104 | 7/1905 | United Kingdom | 38/70 |

*Primary Examiner*—C. D. Crowder
*Assistant Examiner*—Bibhu Momanty

[57] ABSTRACT

An abdominal binder stretcher comprising, in combination, a pair of rigid planar members having coplanar upper edges and coplanar lower edges with parallel exterior and interior edges. The planar members have front faces and rear faces. A pair of hinges couple together the interior edges of the planar members for pivoting about the axis of the hinges. A plurality of nails extend at right angles from the front surfaces of the planar members. The nail are in vertical lines adjacent to the exterior edges of the planar members. A pair of elongated support bars have a height essentially equal to the height of the planar members with exterior edges alignable with the exterior edges of the planar members and interior edges extending to an intermediate extent of the planar members and adapted to cover the nails. A pair of apertures extend through each elongated support bar and its associated planar member. Four bolts extend through the apertures of the planar members and elongated support bars with wing nuts to hold the elongated support bars adjacent to the planar members to ensure the retention of the edges of an abdominal binder received on the nails.

2 Claims, 4 Drawing Sheets

ABDOMINAL BINDER STRETCHER

BACKGROUND OF THE INVENTION

1. Field of the Invention

The present invention relates to an abdominal binder stretcher and more particularly pertains to stretching abdominal binders after being washed so as to allow them to dry in the fully extended configuration.

2. Description of the Prior Art

The use of devices for stretching, pressing and smoothing various types of laundered garments, material, fabric, etc. is known in the prior art. More specifically, devices for stretching, pressing and smoothing various types of laundered garments, material, fabric, etc. heretofore devised and utilized for the purpose of to drying, pressing, smoothing etc. a wide variety of articles fabricated of woven and knit material are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,357,869 to Wadstein discloses a device for stretching and fixing a cloth on a frame.

U.S. Pat. No. 4,364,495 to Walker discloses a garment stretcher.

U.S. Pat. No. 4,593,839 to Vandoros discloses a garment stretcher.

U.S. Pat. No. 4,887,626 to Dalo et al. discloses a stretched cloth fixing device.

U.S. Pat. No. 4,665,844 to Shibata discloses a curved cloth stretch frame construction for an embroidery sewing machine.

In this respect, the abdominal binder stretcher according to the present invention substantially departs from the conventional concepts and designs of the prior art, and in so doing provides an apparatus primarily developed for the purpose of to stretch abdominal binders after being washed so as to allow them to dry in the fully extended configuration.

Therefore, it can be appreciated that there exists a continuing need for new and improved abdominal binder stretcher which can be used for to stretch abdominal binders after being washed so as to allow them to dry in the fully extended configuration. In this regard, the present invention substantially fulfills this need.

SUMMARY OF THE INVENTION

In view of the foregoing disadvantages inherent in the known types of devices for stretching, pressing and smoothing various types of laundered garments, material, fabric etc. now present in the prior art, the present invention provides an improved abdominal binder stretcher. As such, the general purpose of the present invention, which will be described subsequently in greater detail, is to provide a new and improved abdominal binder stretcher apparatus and method which has all the advantages of the prior art and none of the disadvantages.

To attain this, the present invention essentially comprises a new and improved abdominal binder stretcher comprising, in combination a pair of rigid planar members having coplanar upper edges and coplanar lower edges with parallel exterior and interior edges, the planar members having front faces and rear faces a pair of hinges coupling together the interior edges of the planar members for pivoting about the axis of the hinges; a plurality of nails extending at right angles from the front surfaces of the planar members, the nails being in vertical lines adjacent to the exterior edges of the planar members; a pair of elongated support bars having a height essentially equal to the height of the planar members with exterior edges alignable with the exterior edges of the planar members and interior edges extending to an intermediate extent of the planar members and adapted to cover the nails, a pair of apertures extending through each elongated support bar and its associated planar member; four bolts extending through the apertures of the planar members and elongated support bars with wing nuts to hold the elongated support bars adjacent to the planar members to ensure the retention of the edges of an abdominal binder received on the nails; an abdominal binder adapted to be mounted on the nails when the planar members are in a loading position with the planar members at angles with respect to each other, the abdominal binder adapted to be stretched to a full extent when the planar members are opened to a drying position with the planar members in a common vertical plane; a latch on the rear face of one of the planar members with an associated eyelet on the other rear face to regain the planar members in a common plane when in the drying position when the latch is in the eyelet; and a hook mounted to the upper edge of one of the planar members for supporting the device in an elevated orientation during the drying of an abdominal stretcher.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved abdominal binder stretcher which has all the advantages of the prior art devices for stretching, pressing and smoothing various types of laundered garments, material, fabric etc. s and none of the disadvantages.

It is another object of the present invention to provide a new and improved abdominal binder stretcher which may be easily and efficiently manufactured and marketed.

It is a further object of the present invention to provide a new and improved abdominal binder stretcher which is of a durable and reliable construction.

An even further object of the present invention is to provide a new and improved abdominal binder stretcher which is susceptible of a low cost of manufacture with regard to both materials and labor, and which accordingly is then susceptible of low prices of sale to the consuming public, thereby making such devices for stretching, pressing and smoothing various types of laundered garments, material, fabric etc. s economically available to the buying public.

Still yet another object of the present invention is to provide a new and improved abdominal binder stretcher which provides in the apparatuses and methods of the prior art some of the advantages thereof, while simultaneously overcoming some of the disadvantages normally associated therewith.

Still another object of the present invention is to stretch abdominal binders after being washed so as to allow them to dry in the fully extended configuration Lastly, it is an object of the present invention to provide a new and improved abdominal binder stretcher comprising, in combination a pair of rigid planar members having coplanar upper edges and coplanar lower edges with parallel exterior and interior edges, the planar members having front faces and rear faces a pair of hinges coupling together the interior edges of the planar members for pivoting about the axis of the hinges; a plurality of nails extending at right angles from the front surfaces of the planar members, the nails being in vertical lines adjacent to the exterior edges of the planar members; a pair of elongated support bars having a height essentially equal to the height of the planar members with exterior edges alignable with the exterior edges of the planar members and interior edges extending to an intermediate extent of the planar members and adapted to cover the nails, a pair of apertures extending through each elongated support bar and its associated planar member; and for bolts extending through the apertures of the planar members and elongated support bars with wing nuts to hold the elongated support bars adjacent to the planar members to ensure the retention of the edges of an abdominal binder received on the nails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part throughout the various figures.

DESCRIPTION OF THE PREFERRED EMBODIMENT

Figure 1:
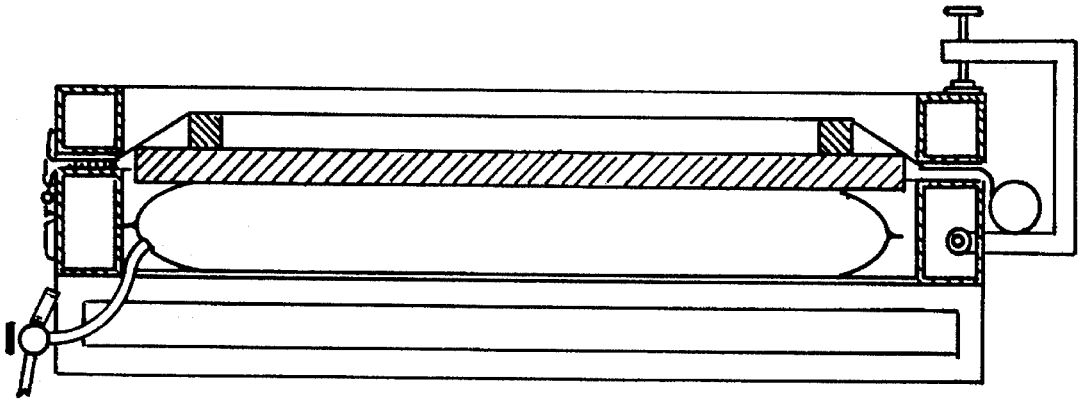
FIG 1 PRIOR ART
FIG. 1 is a cross-sectional illustration of one type of stretching device for laundered articles.
Figure 2:
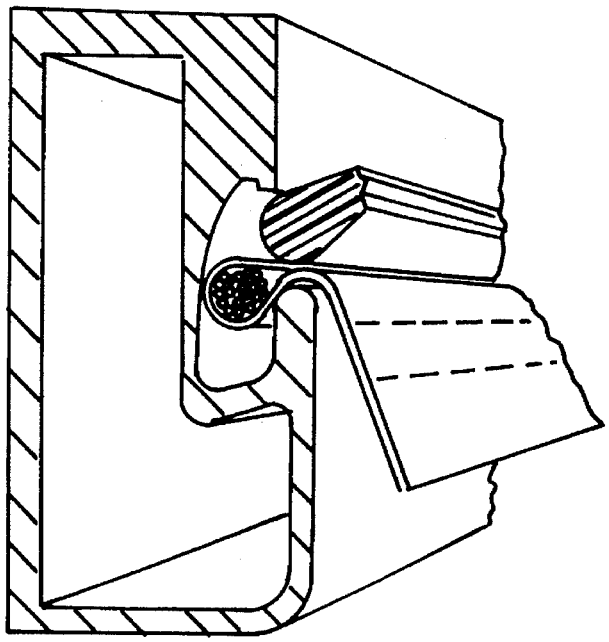
FIG 2 PRIOR ART
FIG. 2 is another type of prior art device used for stretching laundered material.
Figure 3:
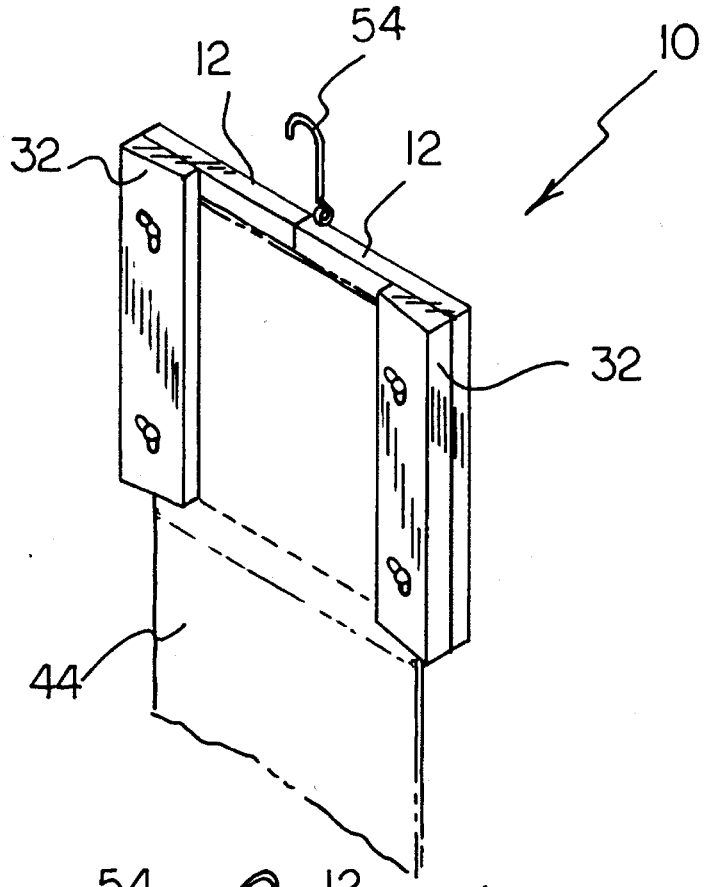
FIG. 3 is a perspective illustration of the preferred embodiment of the new and improved abdominal binder stretcher constructed in accordance with the principles of the present invention.
Figure 4:
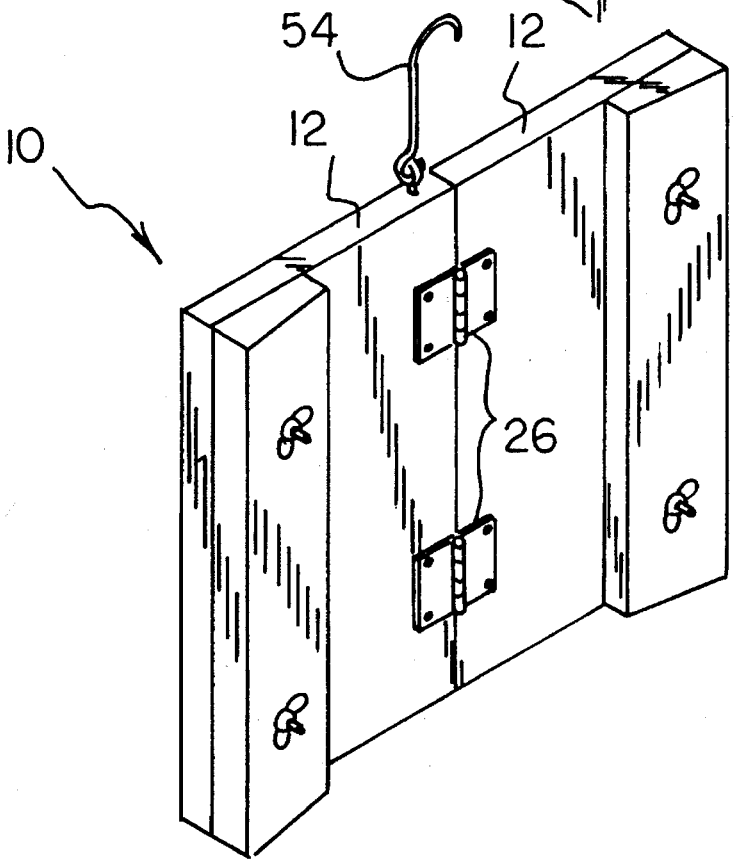
FIG. 4 is an enlarged perspective illustration of the device shown in FIG. 1 but with the abdominal binder removed.

With reference now to the drawings, and in particular to FIG. 1 thereof, a new and improved abdominal binder stretcher embodying the principles and concepts of the present invention and generally designated by the reference numeral 10 will be described.

The present invention, the new and improved abdominal binder stretcher is a system 10 comprised of a plurality of components such components include, in their simplest terms, rigid planar members, hinges, nails, support bars, bolts, a latch and a hook, such components are individually configured and correlated with respect to each other so as to obtain the desired objective.

The central component of the system 10 of the present invention is a pair of rigid planar members 12. Such planar members have coplanar upper edges 14 and coplanar lower edges 16. They also have the parallel exterior and interior edges 18, 20. In the operative orientation the planar members are in a common vertical plane and stretch an abdominal binder to its full extent. The planar members are opened to a drying position with the planar members positioned in a common vertical plane. The planar members also have front faces 22 and rear faces 24. Coupling between the planar members is through a pair of hinges 26. The hinges coupled together the interior edges of the planar members. This allows for their pivoting about the axis of the hinges.

For supporting the abdominal binder thereon, a plurality of nails 30 extend at right angles from the front surfaces of the planar members. The nails are adapted to receive an abdominal binder when the planar members are in a loading position with the planar members at angles with respect to each other. The nails are in vertical lines, one per planar member, adjacent to the exterior edges of the planar members. Covering of the nails is effected through a pair of elongated support bars 32. Each bar has a height essentially equal to the height of the planar members. Each support bar has an exterior edge alignable with the exterior edges of the planar members. Each support bar has an exterior edge extending to an intermediate extent of the planar member. The support bars are adapted to cover the nails to retain the abdominal stretcher in place. Apertures 34 extend through each elongated support bar and its associated planar member in axially alignment.

Coupling between the support bars and the planar members is through four bolts 38. Such bolts extend through the apertures of the planar members and elongated support bars. Wing nuts 40 hold the elongated support bar adjacent to the planar members to ensure the retention of the edges of the abdominal binder received on the nails.

The abdominal binder 44 is a stable item of commerce. The abdominal binder is formed in a planar generally rectangular configuration with edges. It is adapted to be mounted at its edges on the nails. Such mounting occurs when the planar members are in a loading position with the planar members at angles, preferrably right angles with respect to each other. The abdominal binder is adapted to be stretched to a full extent for drying when the planar members are opened to a drying position with the planar members in a common vertical plane.

Figure 5:
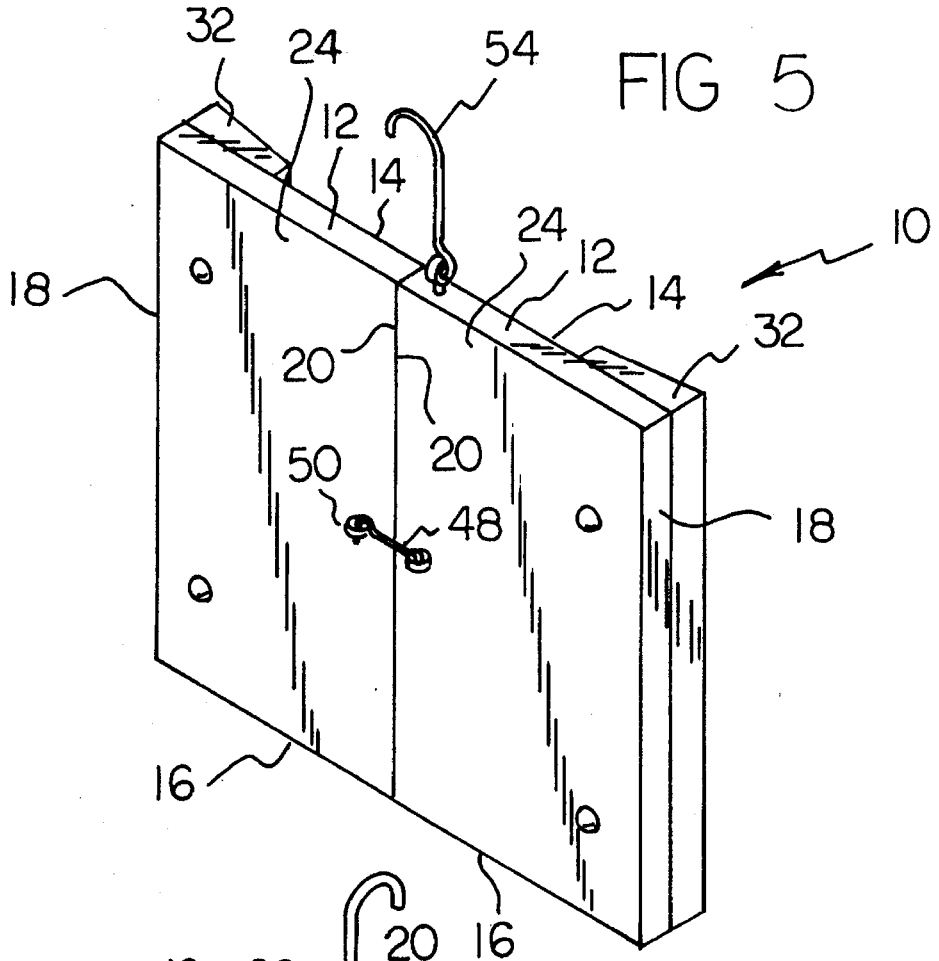
FIG. 5 is a perspective illustration similar to FIGS. 3 and 4 but shown from the opposite side thereof.
Figure 6:
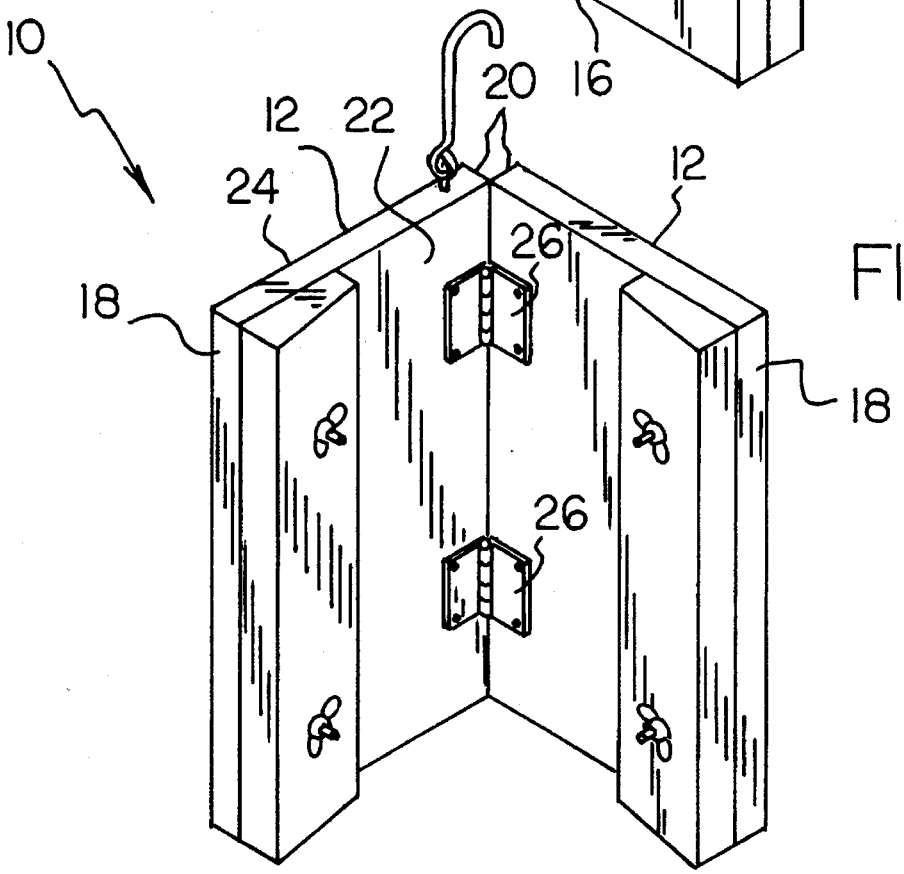
FIG. 6 is a perspective illustration of the device of FIGS. 3, 4, and 5 but illustrating it in the partially opened condition ready for accepting the abdominal binder for being stretched and dried.
Figure 7:
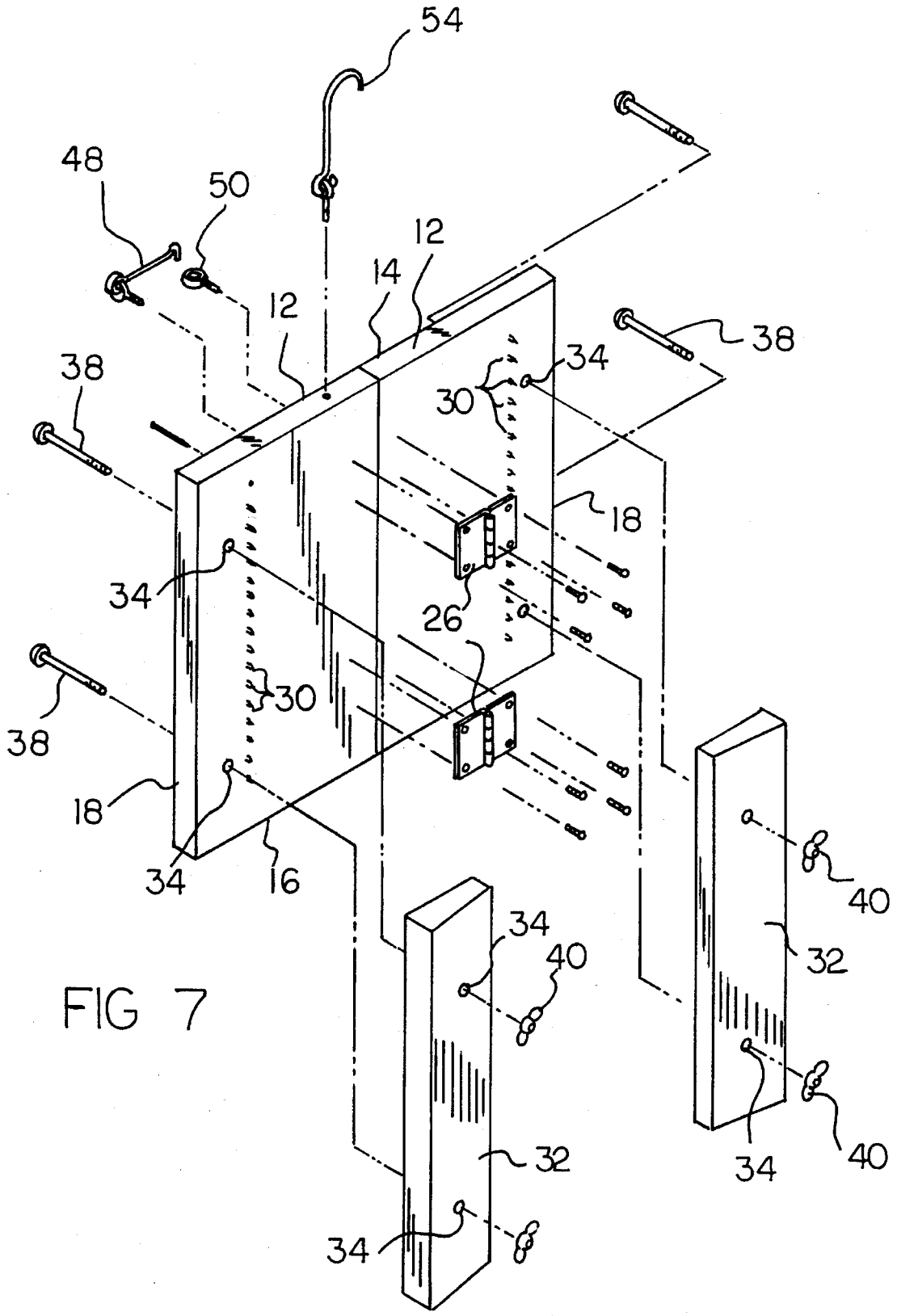
FIG. 7 is an exploded perspective view of the device of FIGS. 3 thru 6.

Located on the rear face of one of the planar members is a latch. The latch is rotatably coupled to a first eyelet. The first eyelet is attached within the rear face of one of the planar members. An associated second eyelet 50 is on the other rear face of the other planar member. The latch and second eyelet are functioned to retain the planar member in a common plane when in the drawing position and when the latch is in the second eyelet. Note FIG. 5.

The last component of the system is a hook 54. The hook is mounted as through a n eyelet 56 with the screw end to the upper edge of one of the planar members. The hook functions for supporting the device in an elevated orientation in a vertical plane during the drying of the abdominal stretcher.

The present invention is a medical device that is wrapped about a patient's abdominal area to support weak muscles or hold a hernia in place. It is made of an elastic-type fabric material and comes in widths of 3 to 12 inches and in small, medium, large, and extra large lengths for different waist sizes. The binders are washable but cannot be dried in a dryer. Instead they are usually laid out flat to dry.

The present invention is a stretching device used to stretch a binder during drying, immediately after it has been washed. The stretcher defined herein is for a 9 inch wide binder. It is made from two ¾ inch thick boards that are 5 ½ inches wide by 12 ½ inches long with two beveled boards that are 2 inches wide by 12 ½ inches long. The two 5 ½ inch boards are held together with two hinges. The two 2 inch boards are fastened to the outside edges of the 5 ½ inch boards with bolts and wing nuts about ½ inch from their outside edges; these boards act as holding clamps for the binder. Nails are spaced ½ inch apart longitudinally on each of the 5 ½ inch boards just inside each of the 2 inch boards. A hook and eye on opposite sides of the hinge joint are fastened to the back of the present invention. When hooked together, they hold the stretcher in an open or flat position. To hang while drying, a hanger is secured to its top.

The present invention is opened with the hinged boards at right angles to each other and the holding clamps removed. The edges of the wet binder are pressed over the nails, the holding clamps are placed over the binder's edges and held in place with the bolts and wing nuts, the stretcher is unfolded to an open position and locked in place to stretch the binder. It is then hung up to dry for approximately 24 hours. The present invention should extend the length of a binder.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved abdominal binder stretcher for use in association with an abdominal binder formed in a planar rectangular configuration with edges, the apparatus comprising, in combination:

a pair of rigid planar members having coplanar upper edges and coplanar lower edges with parallel exterior and interior edges, the planar members having front faces and rear faces, in an operative orientation the planar members being in a common vertical plane and stretching an abdominal binder to its full extent;

a pair of hinges coupling together the interior edges of the planar members for pivoting about the axis of the hinges;

a plurality of nails extending at right angles from the front surfaces of the planar members, the nails being in vertical lines adjacent to the exterior edges of the planar menders, the nails being adapted to receive an abdominal binder when the planar members are in a loading position with the planar members at angles with respect to each other, the planar members being opened to a drying position with the planar members in a common vertical plane;

a pair of elongated support bars having a height essentially equal to the height of the planar members with exterior edges alignable with the exterior edges of the planar members and interior edges extending to an intermediate extent of the planar members and adapted to cover the nails, a pair of apertures extending through each elongated support bar and its associated planar member;

four bolts extending through the apertures of the planar members and elongated support bars with wing nuts to hold the elongated support bars adjacent to the planar members to ensure the retention of the edges of an abdominal binder received on the nails;

a latch rotatably coupled to a first eyelet, the first eyelet being attached within the rear face of one of the planar members, the latch on the rear face of one of the planar members with an associated second eyelet on the other rear face to regain the planar members in a common plane when in the drying position when the latch is in the second eyelet;

and a hook mounted to the upper edge of one of the planar members for supporting the device in an elevated orientation during the drying of an abdominal binder.

2. An abdominal binder stretcher for use in association with an abdominal binder formed in a planar rectangular configuration with edges, the apparatus comprising, in combination:

a pair of rigid planar members having coplanar upper edges and coplanar lower edges with parallel exterior and interior edges, the planar members having front faces and rear faces;

a pair of hinges coupling together the interior edges of the planar members for pivoting about the axis of the hinges;

a plurality of nails extending at right angles from the front surfaces of the planar members, the nails being in vertical lines adjacent to the exterior edges of the planar members;

a pair of elongated support bars having a height essentially equal to the height of the planar members with exterior edges alignable with the exterior edges of the planar members and interior edges extending to an intermediate extent of the planar members and adapted to cover the nails, a pair of apertures extending through each elongated support bar and its associated planar member;

four bolts extending through the apertures of the planar members and elongated support bars with wing nuts to hold the elongated support bars adjacent to the planar members to ensure the retention of the edges of an abdominal binder received on the nails; and a latch on the rear face of one of the planar members with an associated eyelet on the other rear face to retain the planar members in a common plane with the latch is in the eyelet.

* * * * *